222-541 SR
10/22/85 XR 4,548,318

United States Patent [19]

Boyle

[11] Patent Number: 4,548,318

[45] Date of Patent: Oct. 22, 1985

[54] 3 CELL RECLOSABLE DISPENSER

[75] Inventor: Daniel J. Boyle, Hartland, Wis.

[73] Assignee: Champion International Corporation, Stamford, Conn.

[21] Appl. No.: 547,033

[22] Filed: Oct. 31, 1983

[51] Int. Cl.[4] ..... B65D 5/72

[52] U.S. Cl. ..... 206/621; 206/630; 229/15; 229/17 R; 229/27; 222/541

[58] Field of Search ..... 206/621, 634, 613, 614, 206/607, 608, 622, 626, 628, 630, 610, 611, 604, 601, 631, 633; 229/17 R, 15, 27, 7 S, 28 R; 222/541

[56] References Cited

U.S. PATENT DOCUMENTS

| | | | |
|---|---|---|---|
| Re. 31,425 | 10/1983 | Steinke et al. | 206/611 |
| 1,157,712 | 10/1915 | Miller | 229/15 X |
| 1,940,849 | 12/1933 | Davidson | 206/630 X |
| 3,057,533 | 10/1962 | Silver | 229/17 R |
| 3,096,918 | 7/1963 | Van Dyke et al. | 225/48 |
| 3,157,344 | 11/1964 | Hennessey | 229/27 |
| 3,269,635 | 8/1966 | Bergstein et al. | 206/633 X |
| 3,570,745 | 3/1971 | Fuse-Shi et al. | 229/17 R |
| 3,596,829 | 8/1971 | Gardner | 229/7 S |
| 4,062,486 | 12/1977 | Goodrich | 206/626 |
| 4,436,206 | 3/1984 | Kuchenbeeker | 206/625 |

FOREIGN PATENT DOCUMENTS

| | | | |
|---|---|---|---|
| 678523 | 7/1960 | Canada | 229/17 R |
| 6604602 | 10/1967 | Netherlands | 229/28 R |

*Primary Examiner*—Allan N. Shoap
*Assistant Examiner*—Bryon Gehman
*Attorney, Agent, or Firm*—Evelyn M. Sommer

[57] ABSTRACT

A reclosable carton includes a front wall provided with a lightly nicked circular portion. A top wall panel connected to a back wall is provided with a top wall panel extension defining a cover flap. Centrally located on the cover flap is a debossed circular area which is adapted to overlie and be adhesively secured to the lightly nicked circular portion on the front wall panel. As the cover flap is lifted by pulling outwardly and upwardly on the tab, it is torn between the pair of parallel score lines and the lightly nicked portion of the front wall adheres to the cover flap and is removed from the front wall to provide a dispensing opening through which articles may be singly dispensed from the interior of the carton. The cover flap may be rotated and pushed back against the carton front wall to cause the lightly nicked area of removed paperboard stock adhered to the cover flap to frictionally lock within the opening to reclose the carton.

3 Claims, 17 Drawing Figures

Fig. 10.
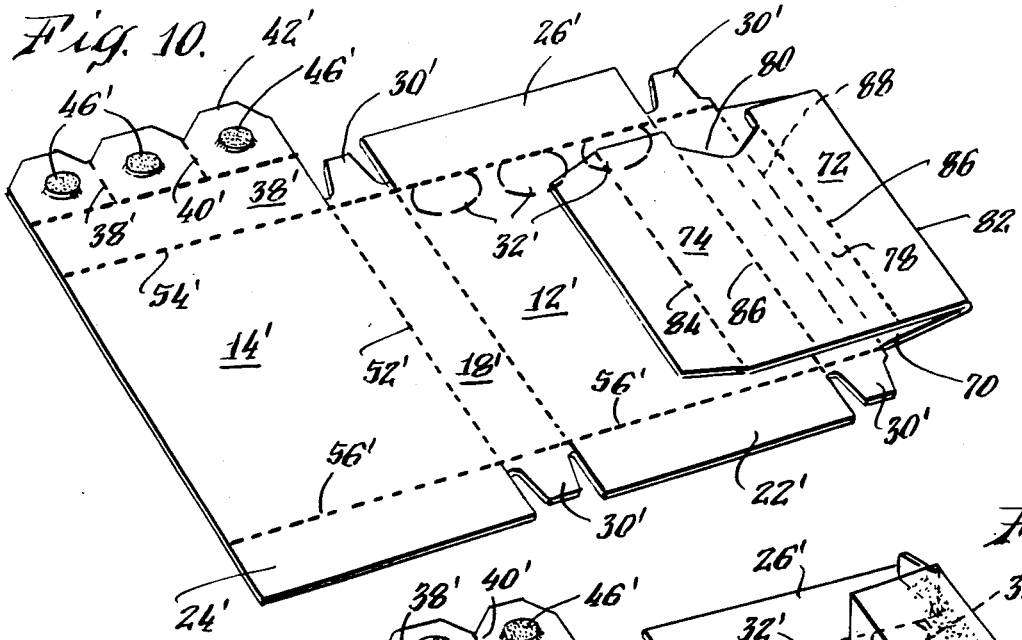
Fig. 11.
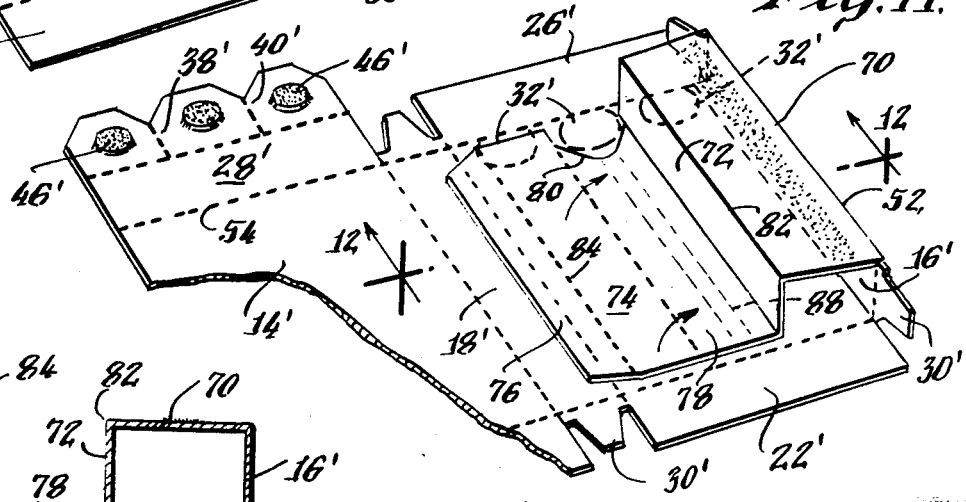
Fig. 12.
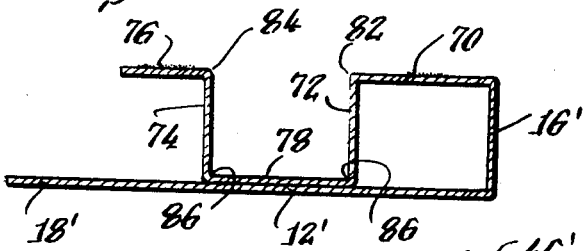
Fig. 13.
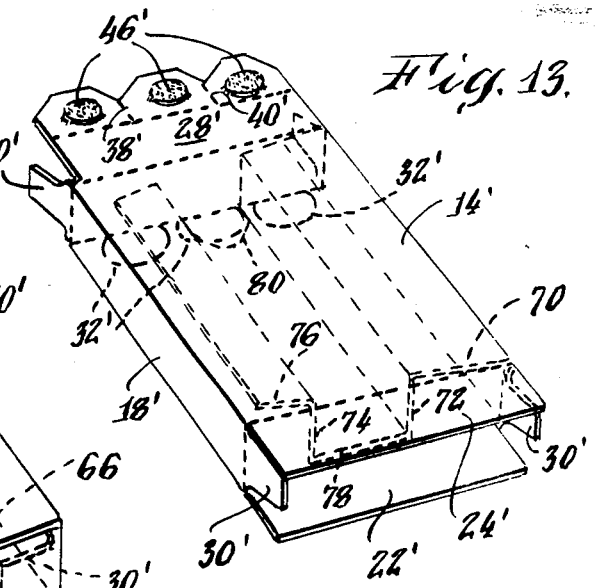
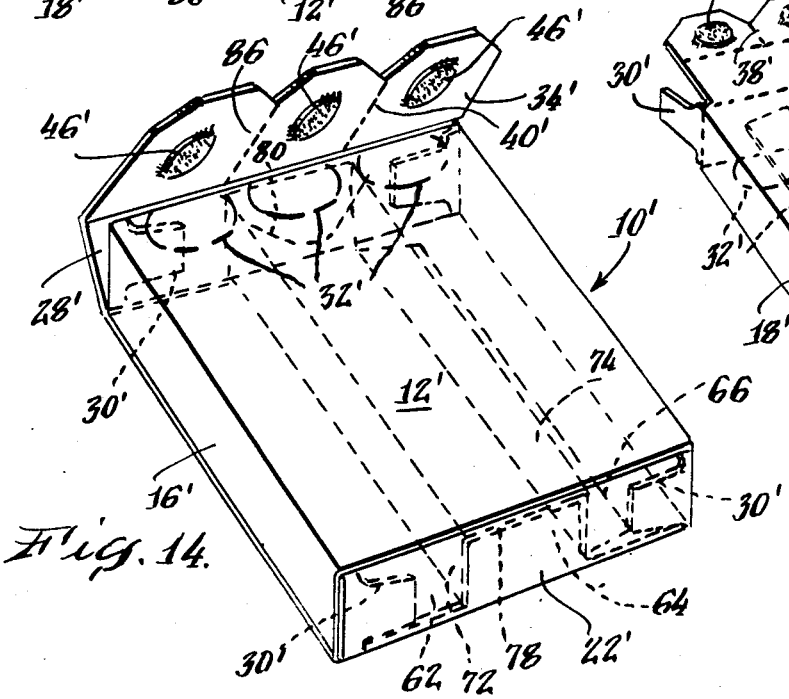
Fig. 14.

3 CELL RECLOSABLE DISPENSER

BACKGROUND AND SUMMARY OF THE INVENTION

This invention relates to a carton construction, and more particularly, to a reclosable carton for dispensing small round articles one at a time.

Heretofore, it has been common to dispense small articles, such as candy tablets, from a paperboard carton having a sliding top panel which could be slid to expose an opening in the top of the carton through which a candy tablet or the like could be dispensed and then the top wall closed by resliding the panel laterally along the top of the carton to cover the dispensing opening. If such carton constructions are formed from a unitary blank, they must include intricately designed panels and folds utilizing substantial amounts of paperboard.

The present invention relates to a carton construction for dispensing round articles, such as candy tablets, one at a time wherein the carton is formed from a simple, unitary paperboard blank having a minimal number of panels. Further, the carton dispensing opening may be reclosed by simply pivoting a cover flap which includes means for locking the flap in closing relation over the dispensing opening.

In accordance with the invention, the carton includes a front wall, back wall, a first side wall, and a second side wall which form a tube. Connected to the bottom edges of the front and back walls are panels which may be overlapped and sealed to form a bottom wall. The carton also includes a first and second panel connected to the top edges of the front and back walls which are overlapped to seal the top of the carton and form a top wall.

The front wall of the carton is provided with a lightly nicked circular portion. The top wall panel connected to the back wall is provided with a top wall panel extension which includes a central portion defined by a pair of parallel score lines terminating in a tab extending from the free edge of the second top wall panel extension; the central portion of the top wall panel extension and tab defining a cover flap. Centrally located on the cover flap is a debossed circular area which is adapted to overlie and be adhesively secured to the lightly nicked circular portion on the front wall panel.

As the cover flap is lifted by pulling outwardly and upwardly on the tab, it is torn between the pair of parallel score lines and the lightly nicked portion of the front wall adheres to the cover flap and is removed from the front wall to provide a dispensing opening through which articles may be singly dispensed from the interior of the carton.

In order to reclose the carton, the cover flap is merely rotated and pushed back against the carton front wall causing the lightly nicked circular portion of removed paperboard stock adhered to the cover flap to frictionally lock within the dispenser opening. The debossed circular portion on the cover flap creates an adhesive locking area between the cover flap and circular portion which has been removed from the front wall, enabling the remover stock to be repositioned within the dispensing opening and pushed therein.

In a second embodiment of the invention, the interior of the carton may be partitioned into multiple columns by the use of an integral partitioning panel extending from a side edge of one side wall of the carton and folded into a U-shape within the interior of the carton.

A comparable number of cover flaps and removable, lightly nicked portions on the exterior surface of the front wall panel of the carton are provided so that individual access to each individual partition and stack of tablets within the interior of the carton can be had by uncovering each cover flap and the opening formed therebeneath and the reclosing each opening by pressing the corresponding cover flap back in place so that the removed slightly nicked circular portion of the front wall is reseated within the formed dispensing opening.

BRIEF DESCRIPTION OF THE DRAWINGS

Further objects and advantages of the invention will become apparent from the following description and claims, and from the accompanying drawings, wherein:

FIGS. 10, 11, 13, 14 are perspective views illustrating successive steps in the folding of the blank of FIG. 9 to form a carton in accordance with the present invention;

FIG. 12 is a cross-sectional view taken substantially along the plane indicated by line 12—12 of FIG. 11.

DETAILED DESCRIPTION OF THE PREFERRED EMBODIMENTS

Figure 1:
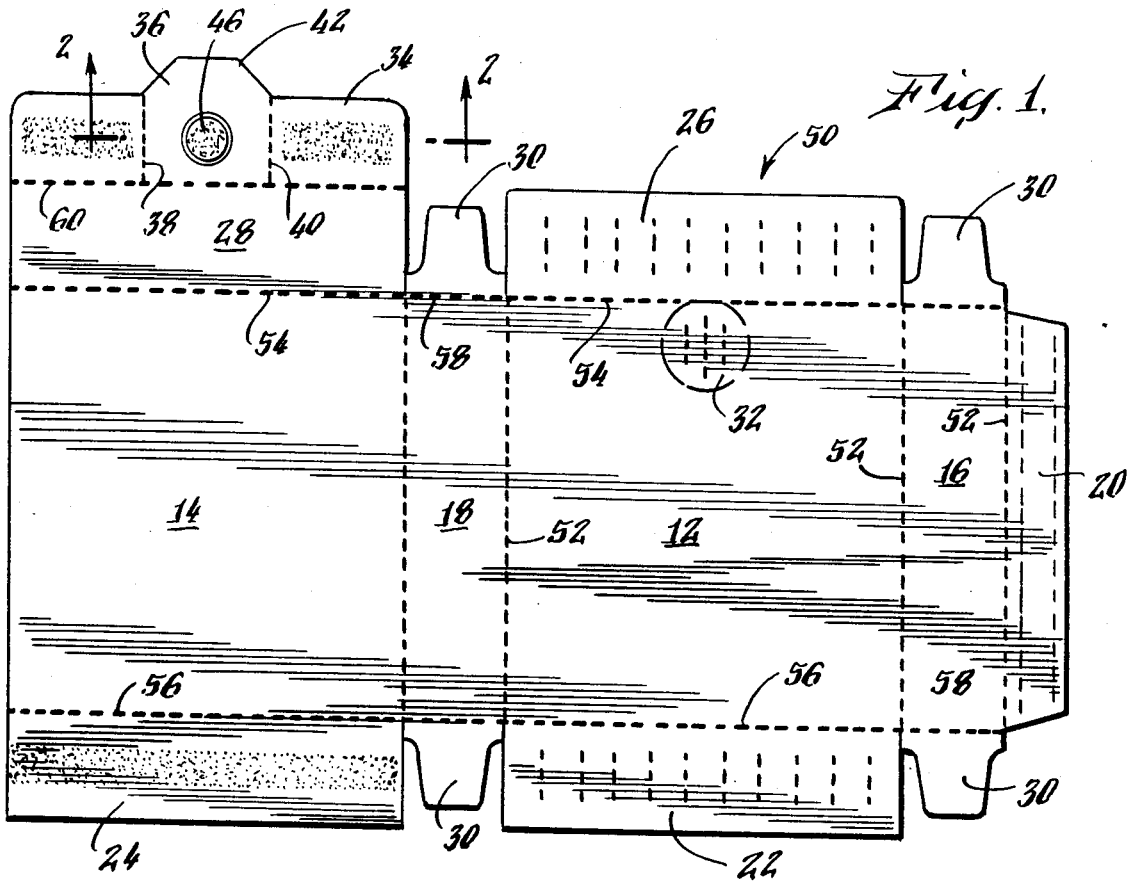
FIG. 1 is a plan view of a blank for forming the reclosable carton of the present invention.
Figure 2:
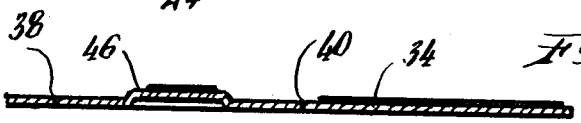
FIG. 2 is a cross-sectional view taken substantially along the plane indicated by line 2—2 of FIG. 1.

Referring now to the drawings in detail, wherein like numerals indicate like elements throughout th several views, the carton 10 of the present invention includes a front wall 12, a back wall 14, a first side wall 16, and a second side wall 18 forming a tube by the adhering of glue flap 20 to the interior surface of back wall 14. Connected to the bottom edge of front and back walls 12, 14, respectively, are first and second bottom panels 22, 24 which may be overlapped and sealed to form a bottom wall 25. The top wall 27 of the carton 10 also includes a first and second rectangular panel 26, 28, which are foldably connected to the top edge of front wall 12 and back wall 14, respectively, which are overlapped and sealed to form the top wall of the carton. Conventional tuck flaps 30 for aligning the wall panels of the carton are foldably connected to the top and bottom edges of side wall 16, 18, respectively, and are positioned beneath the overlapped bottom wall 25 and top wall 27, respectively.

Figure 5:
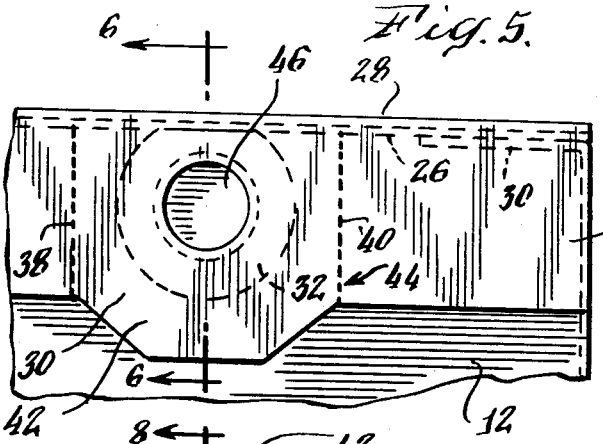
FIG. 5 is a partial front view in elevation of the top of the carton of the present invention formed from the blank of FIG. 1.
Figure 6:
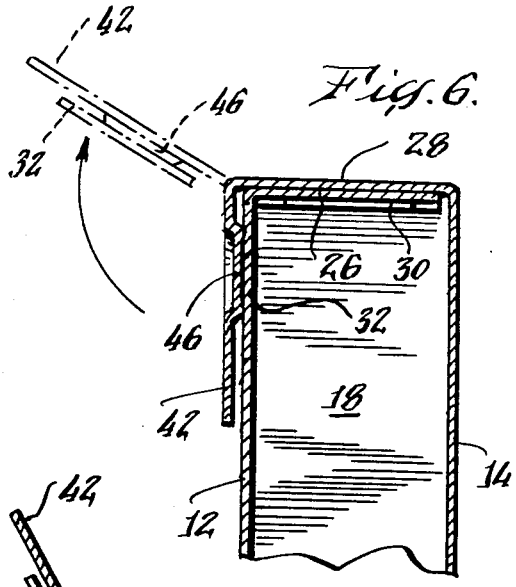
FIG. 6 is a cross-sectional view taken substantially along the plane indicated by line 6—6 of FIG. 5 and showing the manner of opening the carton in phantom lines.

The front wall 12 of the carton 10 is provided with a lightly nicked circular portion 32. The top wall panel 28 connected to the back wall 14 is provided with a top wall panel extension 34 which includes a central portion 36 defined by a pair of parallel score lines 38, 40 terminating in a tab 42 extending from the free edge of the second top wall panel extension 34. The central portion 36 of the top wall panel extension 34 and tab 42 define a cover flap 44. Centrally located on the cover flap 44 is a debossed circular area 46 which is adapted to overlie and be adhesively secured to the lightly nicked circular portion 32 on the front wall panel 12 (see FIGS. 5 and 6).

Figure 7:
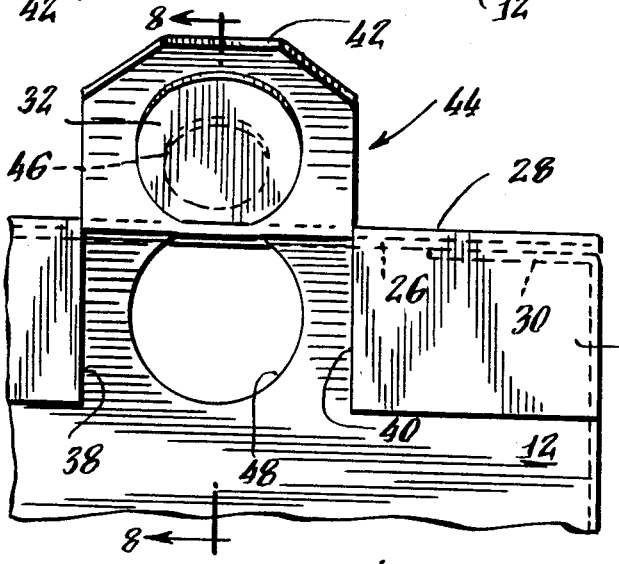
FIG. 7 is a view similar to FIG. 5, but with the carton opened.
Figure 8:
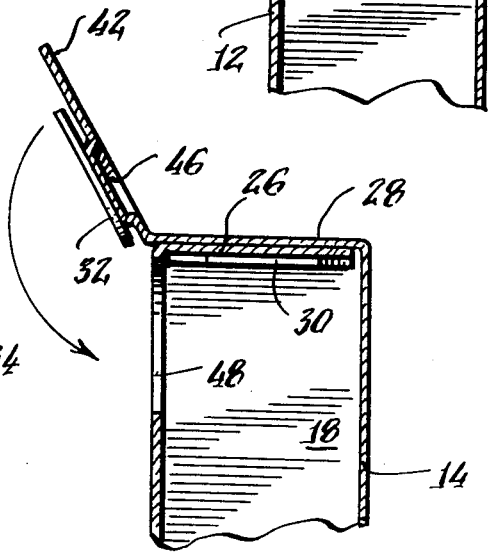
FIG. 8 is a cross-sectional view taken substantially along the plane indicated by line 8—8 of FIG. 7.

As the cover flap 44 is lifted it is torn between the pair of parallel score lines 38, 40 and the lightly nicked portion 32 of the front wall 12 adheres to the cover flap 44 and is removed from the front wall 12 to provide a dispensing opening 48 through which articles may be singly dispensed from the interior of the carton 10 (see FIGS. 7 and 8).

In order to reclose the carton 10, the cover flap 44 is merely rotated and pushed back against the carton front wall 12 causing the lightly nicked circular portion of removed paperboard stock 32 adhered to the cover flap 44 to frictionally lock within the dispensing opening 48. The debossed circular portion 46 on the cover flap 44 creates an adhesive locking or securement area between the cover flap 44 and circular portion 32 which has been removed from the front wall 12 enabling the removed stock to be repositioned within the dispensing opening 48 and pushed therein.

The reclosable dispenser carton 10 is formed from the unitary paperboard blank 50 illustrated in FIG. 1.

The blank 50 includes rectangular back wall panel 14, first side wall panel 18, front wall panel 12, second side wall panel 20, and glue panel 20 joined along their common edges by vertical score lines 52. First and second rectangular top wall panels 26, 28 are joined to the top edges of front and back walls 12, 14, respectively, by horizontal score lines 54, while first and second rectangular bottom wall panels 22, 24, are joined to the bottom edges of front and back walls 12, 14 respectively, by horizontal score lines 56. The tabs 30 are also joined to the top ad bottom edges of the first and second side walls 18, 20 by horizontal score line 58, while second top wall panel extension is joined to top wall panel 28 by a horizontal score line 60.

Figure 3:
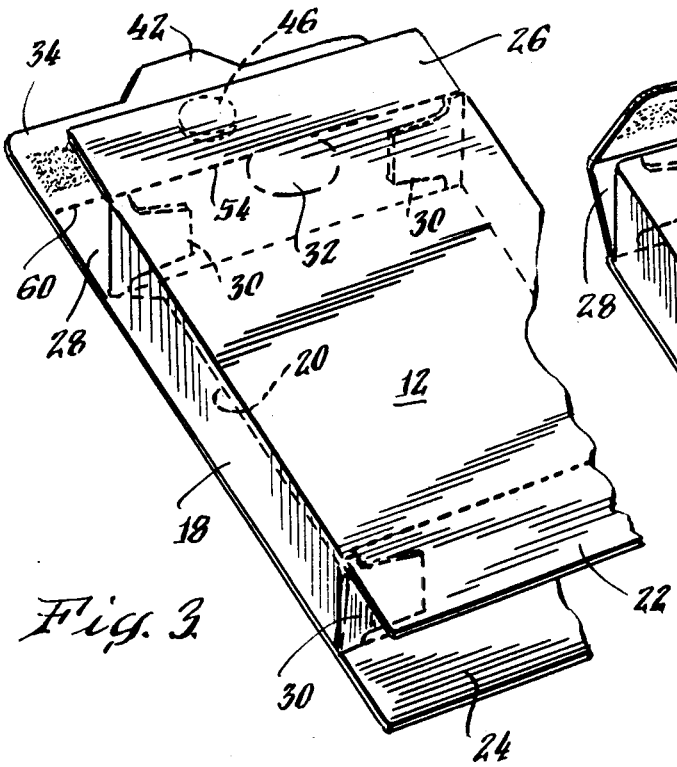
FIGS. 3 and 4 are perspective views illustrating successive steps in the folding the blank of FIG. 1 to form the carton of the present invention.
Figure 4:
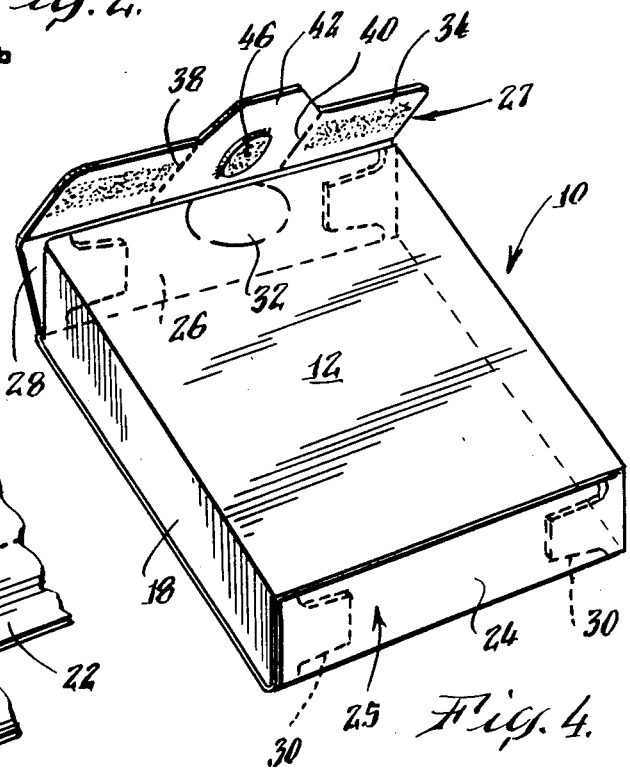

As illustrated in FIGS. 3 and 4, the carton 10 is formed from blank 50 by folding panels 12–20, inclusive 90° relative to each other about score lines 52 and adhesively securing glue panel 20 to the interior of back wall panel 14 to form a tube. The bottom wall panels 22, 24, along with tabs 30 are then folded 90° about score lines 56, 58, respectively, and panel 22 and 24 secured together. After filling the interior of carton 10 with small round articles, such as candy tablets, the top tabs 30 along with top wall panels 26, 28 are folded 90° about score lines 58 54, respectively and then overlapped panels 26 and 28 are adhesively secured together. Top wall panel extension 34 is then folded 90° about score line 60 and the areas outside of perforated score lines 38, 40 are secured to the front wall 12, while debossed area 46 is secured to the lightly nicked circular portion 32 on front wall 12. The debossed area 46 permits the area around it between score lines 38, 40 to be free of adhesion so that upon lifting cover flap 44 about fold line 60, the nicked portion 32 will only be adhered to flap 44 enabling it to break away from front wall 12.

In a second embodiment of the invention, the interior of the carton 10', illustrated in FIGS. 13 to 17, inclusive, may be partitioned into multiple columns 62, 64, 66 by the use of an integral partitioning panel 68 extending from the side edge of side wall 16' of the carton 12' and folded into a U-shape within the interior of the carton 10'. In all other respects, the carton 10' is identical in construction to carton 10, and similar elements are designated by primed numerals.

Figure 15:
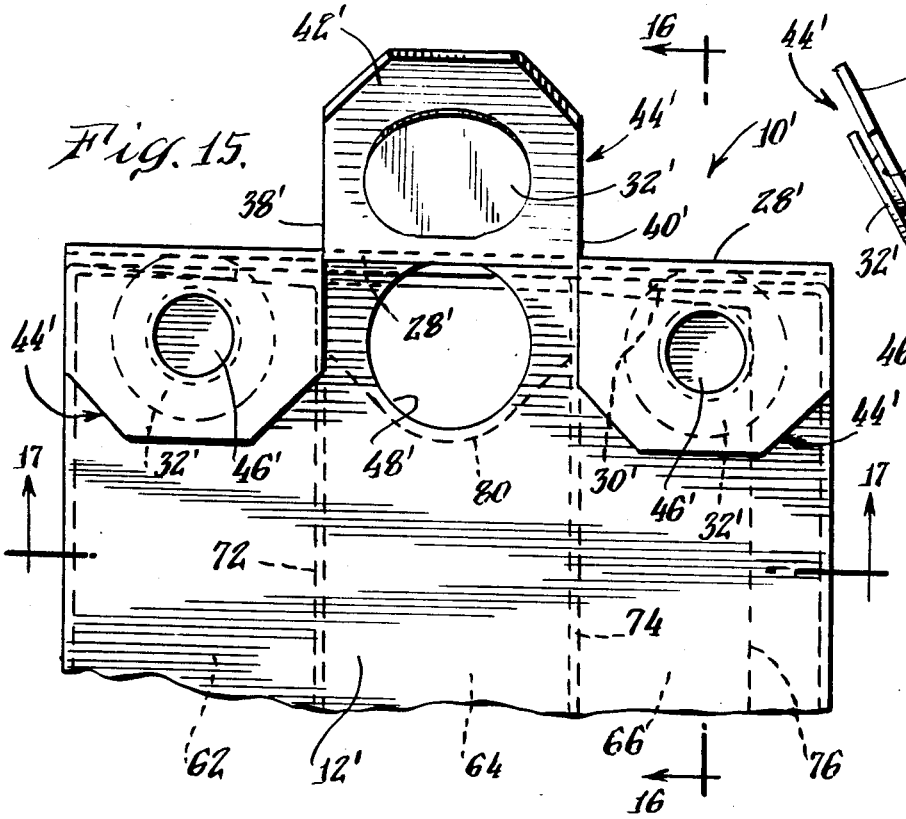
FIG. 15 is a partial front view in elevation of the top of the carton formed from the blank of FIG. 9.
Figure 16:
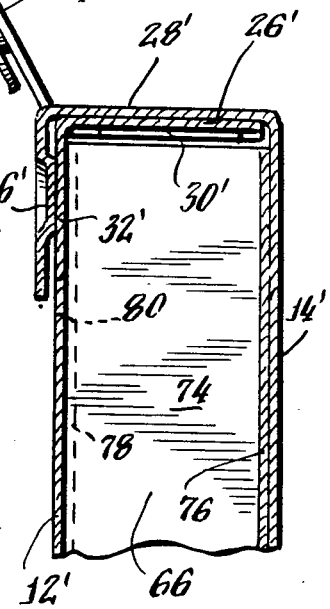
FIG. 16 is a cross-section view taken substantially along the plane indicated by line 16—16 of FIG. 15.
Figure 17:
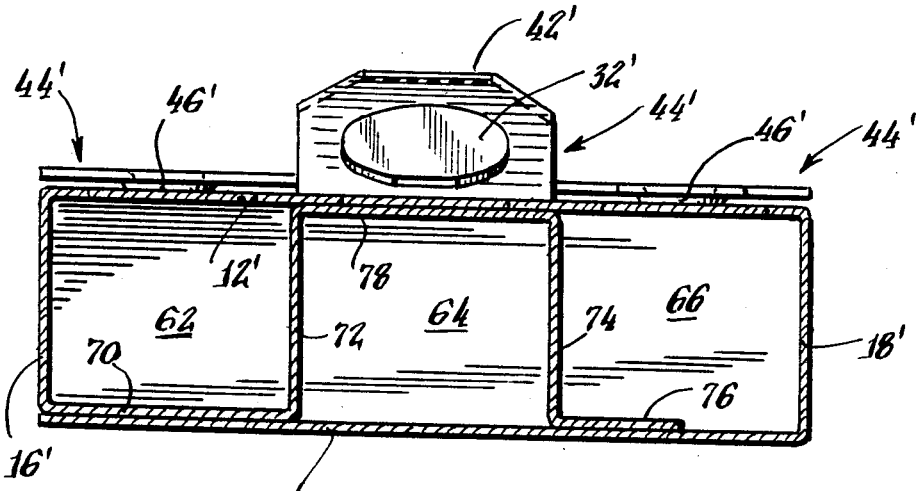
FIG. 17 is a cross-sectional view taken substantially along the plane indicated by line 17—17 of FIG. 15.

A comparable number of cover flaps 44' and removable, lightly nicked portions 32' on the exterior surface of the front wall panel 12' of the carton 10' are provided so that individual access to each individual partition and stack of tablets within the interior of the carton can be had by uncovering each cover flap 44' and the opening 48' formed therebeneath and then reclosing each opening by pressing the corresponding cover flap 44' back in place so that the removed lightly nicked circular portion 32' of the front wall 12' is reseated within the formed dispensing opening 48', as illustrated in FIGS. 15 to 17, inclusive.

Figure 9:
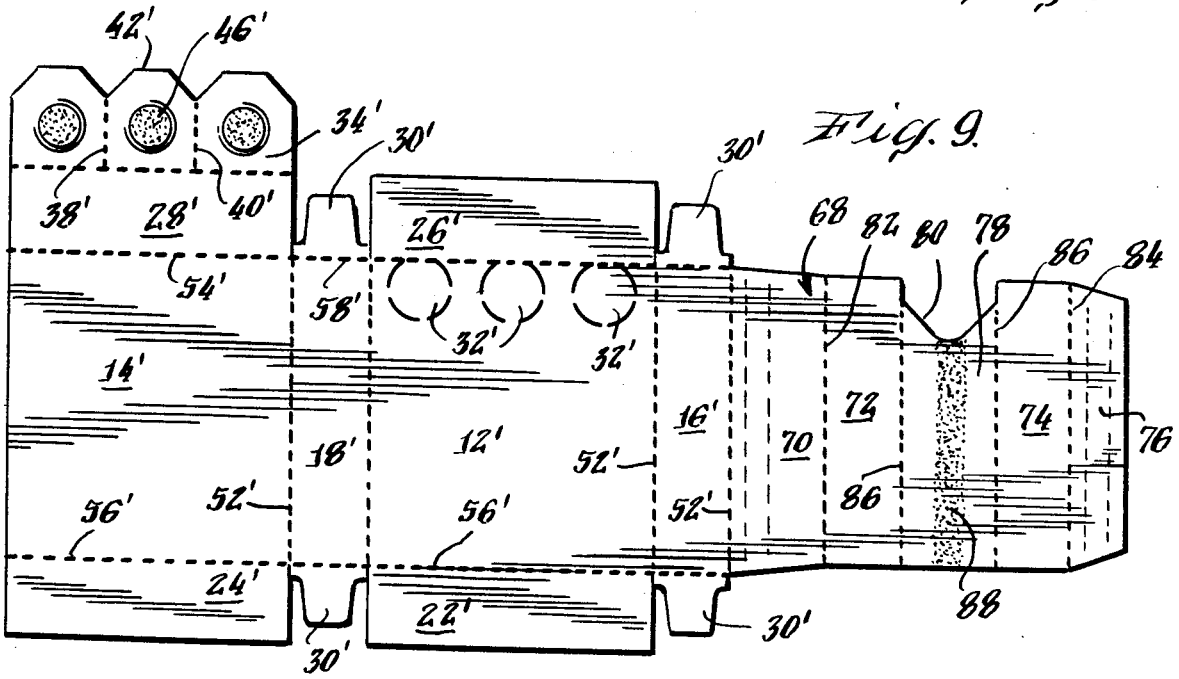
FIG. 9 is a plan view of a blank for forming an alternate embodiment of the reclosable carton of the present invention.

As shown in FIG. 9, the partition panel 68 is foldably connected to a vertical score line 52' forming an edge of second side wall panel 16' and includes a first pair of rectangular panels 70, 72 joined to a second pair of rectangular panels 74, 76 by a central panel 78 having a semi-circular top edge 80. A vertical fold line 82 joins panels 70, 72, while a vertical fold line 84 joins panels 74, 76.

As shown in FIGS. 10 to 12, inclusive, the partition panel 68 is first folded into a U-shaped cross-section by folding panels 70, 72, 90° relative to each other about vertical fold line 82. Similarly, panels 74, 76 are folded 90° relative to each other about fold line 84. Central panel 78 is then folded about its edges 86 90° relative to panels 72 and 74 so that panel 78 is parallel to but spaced from panels 70 and 76 to form the bight of the U. Panel 70 is then folded 90° relative to second side wall panel 16', which in turn in folded 90° relative to front wall panel 12'. Glue is applied to area 88 on central panel 78 and the panel 78 is adhered to the center of the interior of front wall panel 12' with semi-circular top edge 80 beneath the middle lightly nicked area 32' on the front wall panel 12. Back wall 14' is then adhered to the back surface of panel 70, which serves as a glue flap, to form a tubular carton construction provided with columns 62, 64 and 66 between panels 16', 72, and 72, 74, and 74, 18', respectively. Each column is in communication with a lightly nicked portion 32' on the front wall panel 12'; the semi-circular top edge 80 of middle column 64 accomplishing this purpose in that column.

The formation of the top and bottom walls of carton 10' then proceeds as described heretofore in connection with the formation of carton 10, with the score line 38', 40' dividing the top wall extension panel 34' into three cover flaps 44' each of which is provided with a debossed area 46' for adhesion to one of the lightly nicked areas 32'. Since the outer cover flaps 44' have free edges, tearing of perforated score lines 38', 40' will enable lifting and consequent repositioning of each flap and lightly nicked portion 32' to provide selective access to each column 62, 64, or 66 through a dispensing opening 48'.

What is claimed as new is:

1. A carton construction comprising a front wall, a back wall, a bottom wall, a top wall, and a first and second side wall connecting said front and back walls; said top wall including:

a first top wall panel foldably connected to said back wall, a second top wall panel forming an extension of said first top wall panel foldably connected to said first top wall panel, said second top wall panel extension including at least one cover flap defined by a pair of parallel and spaced perforated score lines disposed perpendicular to the fold line between said first top wall panel and said second top wall panel extension and a lift tab connecting said first and second parallel perforated score lines and extending beyond the top edge of said second top wall panel extension, a debossed circular area located on said cover flap, and said front wall including a third top wall panel foldably connected to the top edge of said front wall and secured to the first top wall panel connected to said back wall, and at least one substantially circular weakened line portion formed in said front wall adjacent the top edge of said front wall and having a part of its weakened line portion coexistive with said top edge adapted to be placed in sealed engagement with the debossed area on said cover flap, whereby upon lifting of said cover flap and tearing the same between said parallel perforated score lines, the weakened line portion on said front wall can be removed from said front wall to form a reclosable dispensing opening through which the contents of the carton can be dispensed.

2. A carton as claimed in claim 1 wherein:

an internal partition panel, substantially U-shaped in cross-section, is provided between said front and back walls dividing the interior of said carton into a plurality of segregated compartments, a weakened line portion on the front wall of said carton in communication with each of said segregated compartments, and a cover flap on said second top wall extension adapted to be placed in sealed engagement with each of said weakened line portions to form a reclosable dispensing opening for each of said segregated compartments.

3. A carton as claimed in claim 2 wherein:

said partition panel being foldably connected to one of said first and second side walls, and said partition panel including a first and second pair of rectangular panels joined by a central panel having a substantially semicircular top edge positioned beneath one of said lightly nicked areas on said front wall, said central panel being secured to said front wall and each panel in said first and second pair of rectangular panels being folded 90° relative to the other one of said pair.

* * * * *